United States Patent [19]

Arona-Delonghi

[11] Patent Number: 4,930,688

[45] Date of Patent: Jun. 5, 1990

[54] CAP FOR BOTTLES AND THE LIKE

[75] Inventor: Adriano G. Arona-Delonghi, Monterrey, Mexico

[73] Assignee: Fabricacion de Maquinas, S.A., Monterrey, Mexico

[21] Appl. No.: 311,465

[22] Filed: Feb. 15, 1989

[30] Foreign Application Priority Data

Feb. 15, 1988 [MX] Mexico ..... 10411

[51] Int. Cl.[5] ..... B67D 3/00; B67D 47/00

[52] U.S. Cl. ..... 222/484; 222/519; 222/549; 222/153

[58] Field of Search ..... 222/153, 478, 481, 484, 222/519, 520, 548, 549, 553

[56] References Cited

U.S. PATENT DOCUMENTS

| | | | |
|---|---|---|---|
| 3,317,093 | 5/1967 | Moran | 222/519 |
| 3,471,066 | 10/1969 | Micallef | 222/519 |
| 3,776,433 | 12/1973 | De Treitas | 222/519 |
| 4,480,769 | 11/1984 | Tellini | 222/519 |
| 4,544,063 | 10/1985 | Neward | 222/519 |
| 4,690,304 | 9/1987 | Morel | 222/520 |
| 4,773,103 | 9/1988 | Dahlheimer | 222/548 |
| 4,779,764 | 10/1988 | Debetencourt | 222/153 |

FOREIGN PATENT DOCUMENTS

| | | | |
|---|---|---|---|
| 613958 | 12/1960 | Italy | 222/553 |

*Primary Examiner*—Michael S. Huppert
*Assistant Examiner*—Steven Reiss
*Attorney, Agent, or Firm*—Abelman, Frayne, Rezac & Schwab

[57] ABSTRACT

The present invention relates to an integral supply cap for bottles and the like by which a desired or regulated quantity of a liquid, semi-liquid or viscous product may be dispensed through an internal dispensing orifice. The dispensing orifice is opened by first rotating the cap with an upward movement thus permitting the contained product to exit the bottle and the dispensing orifice is closed and the bottle sealed when the cap is moved in the opposite direction.

11 Claims, 4 Drawing Sheets

CAP FOR BOTTLES AND THE LIKE

FIELD OF THE INVENTION

The present invention relates to a cap for bottles and similar containers designed to contain liquid, semi-liquid, or viscous products.

BACKGROUND OF THE INVENTION

The user of liquid, semi-liquid or relatively viscous liquids, such as edible oils, salad dressing preparations, shampoos, lotions, etc. has always desired a means for dispensing such products in a regulated manner.

However, it is evident that, in practice, the user generally obtains a non-regulated product flow, which much of the time is in an amount or quantity not desired by the user.

Generally, the containers or bottles which contain these products are provided with threaded caps or caps with an unbreakable seal (as in the case of oils). However, a disadvantage of this type of caps is that, when the user needs to remove the cap from the container, it is often found that cap has been affixed too tightly which makes its removal very difficult.

Another disadvantage of these types of caps is that since they are usually manufactured with a removable piece, it is always necessary to remove it from the container in order to extract the contents. This action gives rise to the fact that, when the user repositions the removable piece, it is often not well-seated or properly threaded on the neck of the container, thus increasing the risk of losing the cap and, as a consequence, exposing the container contents to dirt, humidity, etc.

An additional disadvantage of the prior art removable caps is that when the user wishes to obtain a definite or certain quantity of the product, an undesired quantity is often obtained by the user, due to a vacuum action on the inside of the container at the time its contents are extracted.

Still a further disadvantage of these prior art caps is that the majority of them are manufactured in four or five pieces and, therefore, it is necessary to have separate molds, machines and operators for each component, thereby increasing the manufacturing costs.

Based on the above, it was concluded by the inventor of the present invention that, in order to avoid the need of machines and operators for each component part as required by prior art caps, it was necessary to create a combination of components that could be coupled among themselves by simple mechanical assembly of the parts, and which, once assembled, would remain firmly interlocked and fastened together.

Furthermore, it was concluded by the inventor that, in order to reduce the number of components, it was necessary to re-design and simplify the components such that they could be manufactured integrally by a single machine in order to be mechanically assembled together, thus reducing the number of stages and machines to be used in the assembly operation.

In accordance with the above, the present invention relates to a cap for bottles and the like which cap reduces the number of components to only two by providing a design which can be molded on single injection-molding machine.

Additionally, with the cap of the present invention, it is not necessary to remove the cap from the bottles in order to extract the container's contents, since by merely turning one of its components it is possible to obtain a desired quantity of product from the container. The cap includes a detachable ring which is broken when first used, which guarantees that the product will reach the consumer having the same quality as when the bottles were filled, thus preventing the products from being tampered with during the handling thereof between the manufacturer and the consumer. Similarly, once the consumer wishes to close the container, he only needs to turn the cap in the opposite direction in order to return it to its original position.

Similarly, with the cap design of the present invention, the vacuum action inside the container is avoided since the cap has at least two exit orifices, one of which is used to allow the product to exit, and the other of which is used to permit the entry of air into the container.

SUMMARY OF THE INVENTION

It is an object of this invention is to provide an integral cap for bottles and the like, which is manufactured in two pieces, whose components may be coupled together mechanically with a lesser number of manufacturing stages and machines.

Another object of the present invention is to provide an integral cap for bottles and the like which prevents the removal of the cap from the bottles by providing a cap with an integral dispensing or exit orifice which is opened by first rotating the cap with an upward movement which permits the product to exit the bottle, and by movement of the cap in the opposite direction, the bottle is sealed.

Still another object of the present invention is to provide an integral cap for bottles and the like, containing liquid, semi-liquid or viscous products which prevents the formation of a vacuum effect by providing at least two orifices, one for permitting the product to exit and the other for permitting air to enter the container.

BRIEF DESCRIPTION OF THE DRAWINGS

The invention will now be described with reference to the accompanying drawings, which illustrate a preferred embodiment of the invention, and in which.

DETAILED DESCRIPTION OF THE INVENTION

Figure 1:
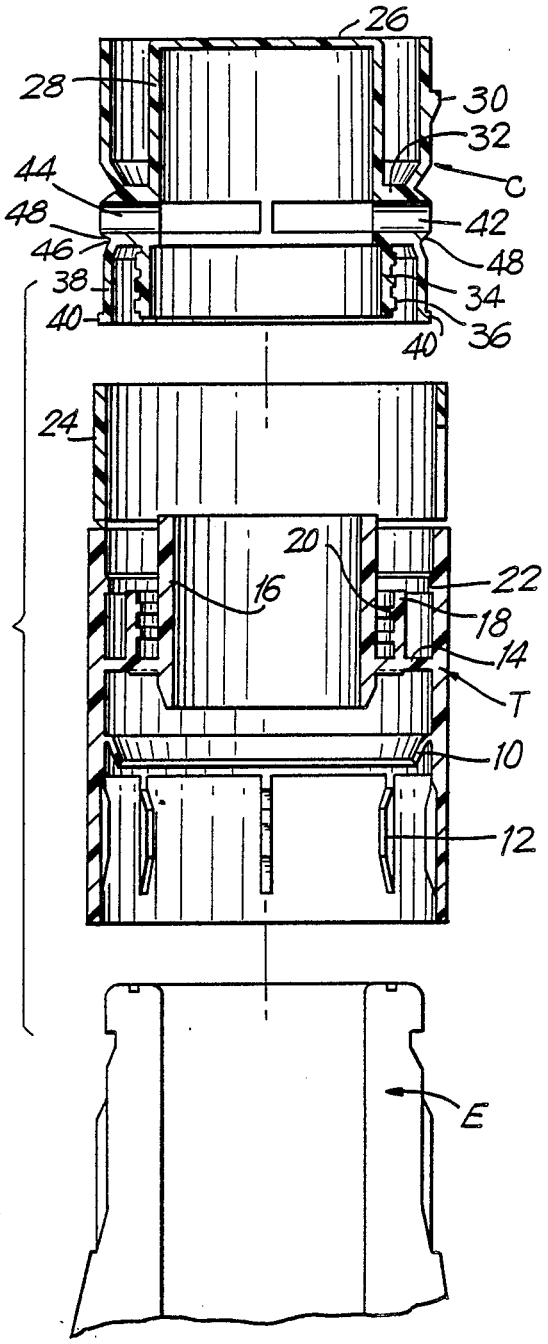
FIG. 1 is an exploded view, in longitudinal form, of the cap showing its components.
Figure 2:
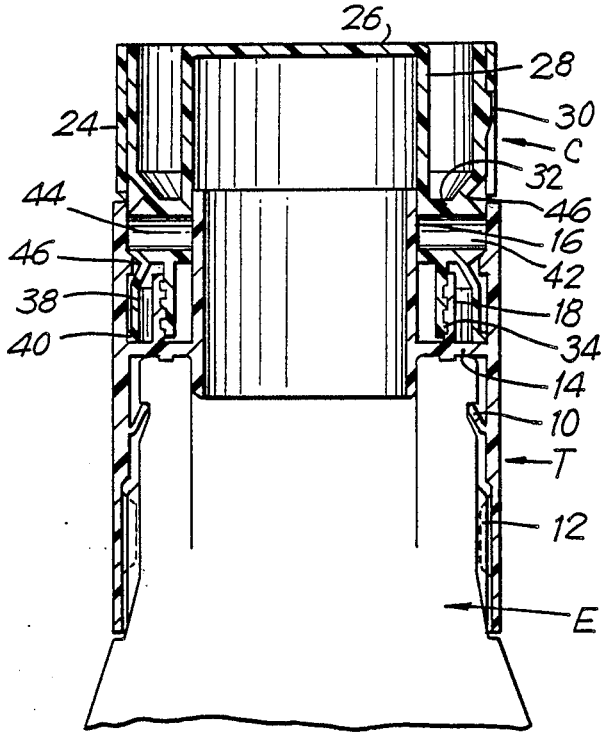
FIG. 2, shows the assembled cap in cross-section.
Figure 4:
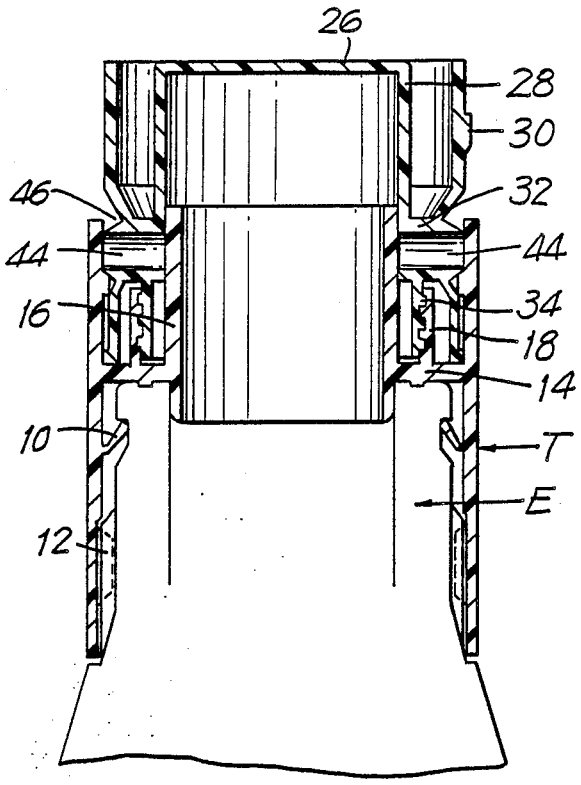
FIG. 4, is another view similar to the view of FIG. 2, showing the cap in the closed position.
Figure 3:
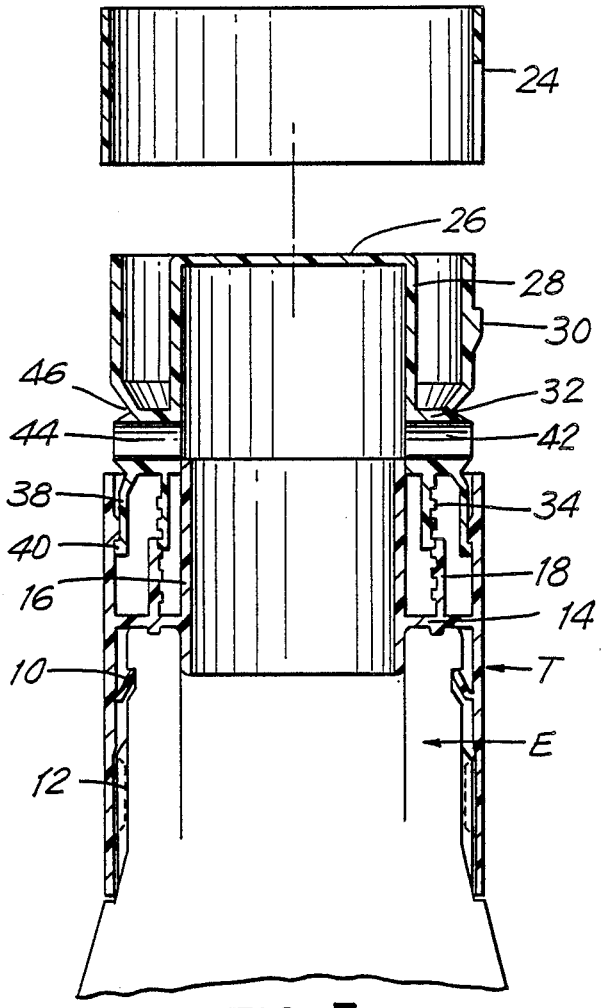
FIG. 3, is another view, similar to the view of FIG. 2, showing the cap in the open position.

Referring now to FIGS. 1 and 2 of the drawings, the cap for bottles and the like includes, in combination, a retention member body T, of plastic material, having a tubular configuration. The retention member body T having, on its lower part, a plurality of vertical fastening ribs 10, which are relatively flexible, which lock against the edge of the neck or crown of the bottle in order to prevent its sliding or slipping upwardly, and a plurality of vertical internal holding legs 12, which interact with the edge of the neck of a bottle E, in order to prevent the retention member body T from turning around or about the bottle E.

In its middle part the body T includes internally, a first annular seating wall 14 which is seated on the mouth of the bottle E; a second annular wall 16, disposed perpendicularly with respect to said seating wall 14, in order to cover, via its lower part, the internal part of the neck of the bottle and, via its upper part, it serves as guide for the cover "C", as will be described hereinafter; and, a third annular wall 18, located between the second annular wall 16 and the internal wall of the retention member body T, from the first annular seating wall 14. The third annular wall 18 having formed on its internal part a threaded section 20 or a series of grooves (not shown).

Also, the upper part of the retention member body T comprises an annular binding or locking edge 22, located on its internal part, and a detachable ring 24 which guarantees the inviolability and tamperproofness of the cap.

A second element of the cap comprises a cover C, which may also be of plastic material, and includes an upper wall 26; a first internal tubular wall 28; a second external tubular wall 30; a fourth annular wall 32 for joining the walls 28 and 30 at the lower end thereof; a third tubular wall 34, located below the fourth annular wall 32 and extending perpendicularly with respect thereto having a threaded section 36 or a series of longitudinal groove (not shown) on its outer edge; and, a fourth tubular wall 38, located below the fourth annular wall 32, which has an interlocking external or outside edge 40.

As may be seen in FIG. 1, the cover C is shown having two orifices, 42 and 44, one permitting the bottled product to exit and the other permitting entry of air into the bottle. The orifices 42 and 44 cross said fourth annular wall 32 transversely, and having, on its outer edge, a small conical cavity 46, from which a small tubular section 48 projects.

ASSEMBLY OF COMPONENTS

As may be seen in FIG. 1, in the assembly of the cap of the present invention, the cover C is first inserted into the upper part of the retention member body T. In this manner, the two components are coupled between the threaded section 20 of the third annular wall 18 and the threaded section 36 of the third tubular wall 34.

There is also a second coupling between the annular locking edge 22 of body T, and the external locking edge 40 of the fourth tubular wall 38, which prevents the cover C from being removed from the body T.

Once the coupling of the components of the present invention has been carried out, the integral cap is assembled on the neck of the bottle E. The lower end of the body T is inserted around or about the neck of the bottle, such that the locking ribs 10 are bent slightly away from the body T, and they remain locked in the neck of the bottle E. The vertical holding legs 12 stop the body T from turning around or about the neck of the bottle.

When it is desired to extract the contents of the bottle, the user can move the cover C with a first upward rotational movement, thereby breaking the detachable ring 24 from the body T. Upon raising the cover C, the orifices 42 and 44 are freed, permitting the extraction of the product contained in the bottle E. Subsequently, once the user has obtained the desired quantity of product, the cover C is turned in the opposite direction, and the orifices 42 and 44 are covered by the internal wall of the body T. Also, the cover C may have an upward and downward vertical movement for extracting the product. This is due to the coupling of the grooves and edges formed in the body T and the cover C.

It will be understood that the embodiment of FIGS. 1 to 4 is the preferred embodiment of the present invention, and that various modifications may be made without departing from the scope of the appended claims.

I claim:

1. A cap for bottles and the like comprising:

(a) a retention member body for coupling hermetically to the mouth of a bottle having, in one end, (i) a plurality of vertical, relatively flexible fastening ribs which lock against the edge of the neck of the bottle to prevent the cap from sliding upwardly and a plurality of internal vertical locking legs which hold the cap on the edge of the neck of the bottle and prevent the cap from turning about the bottle, (ii) a first annular wall attached to the internal part of the retention member body which serves as a seat on top of the mouth of the bottle, (iii) a second annular wall, which acts as a guide, attached to the internal part of the mouth of the bottle and disposed perpendicularly to said first annular wall, and (iv) a first coupling means located between the second annular wall and the internal part of the retention member body;

(b) a cover comprising, (i) a top cap for covering an exit orifice of the bottle which is inserted into said retention member body, (ii) at least one tubular wall coupled to an upper portion of the top cover to guide the cover internally in said second annular wall, (iii) a fourth annular wall attached to the lower end of said at least one tubular wall, (iv) at least one transverse orifice in said fourth annular wall to permit the passage of the contents of the bottle, (v) a second coupling means located on the lower part of said fourth annular wall which is interconnected with the first coupling means of the retention member body whereby when the cover is advanced by an upward movement the contents of the bottle can exit through said orifices and when the cover is retracted by a downward movement the orifices are closed, and (vi) a fourth tubular wall located at the lower part of the fourth annular wall being attached to the internal part of said retention member to prevent the removal of the cap from said retention member body.

2. The cap according to claim 1, wherein the first coupling means is a third annular wall located between the second annular wall and the internal part of the retention member body.

3. The cap according to claim 2, wherein said third annular wall comprises a threaded section.

4. The cap according to claim 2, wherein said third annular wall comprises a series of longitudinal grooves on its internal wall.

5. The cap according to claim 1, wherein the second coupling means comprises a third tubular wall disposed perpendicularly to said fourth annular wall.

6. The cap according to claim 5, wherein the third tubular wall comprises a threaded section on its external wall.

7. The cap according to claim 5, wherein the third tubular wall comprises a series of grooves positioned longitudinally on its external wall.

8. The cap according to claim 1, wherein the retention member body comprises a detachable section.

9. The according to claim 1, wherein the retention member body comprises a first retaining member on its internal edge.

10. The cap according to claim 1, wherein the fourth tubular wall attached to said fourth annular wall includes a second locking retention member on its external edge.

11. The cap according to claim 1, wherein the upward and downward movement between the cover and the retention member body is of a rotational type.

* * * * *